US009335713B2

(12) United States Patent
Saito et al.

(10) Patent No.: US 9,335,713 B2
(45) Date of Patent: May 10, 2016

(54) PHOTOSENSITIVE MEMBER REFRESHING DEVICE AND IMAGE FORMING APPARATUS

(71) Applicant: KYOCERA Document Solutions Inc., Osaka (JP)

(72) Inventors: Yosuke Saito, Osaka (JP); Shigeki Tsukahara, Osaka (JP); Masaki Kadota, Osaka (JP); Ai Takagami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/626,237

(22) Filed: Feb. 19, 2015

(65) Prior Publication Data

US 2015/0234340 A1 Aug. 20, 2015

(30) Foreign Application Priority Data

Feb. 20, 2014 (JP) ..... 2014-030694

(51) Int. Cl.
*G03G 21/00* (2006.01)

(52) U.S. Cl.
CPC ..... *G03G 21/0094* (2013.01); *G03G 21/0011* (2013.01)

(58) Field of Classification Search
CPC ..... G03G 21/0094; G03G 21/0011; G03G 21/0005
See application file for complete search history.

(56) References Cited

U.S. PATENT DOCUMENTS 6,198,491 B1 * 3/2001 Honda ..... B41J 2/471 347/129
2010/0111556 A1 * 5/2010 Shibuya ..... G03G 15/0275 399/71

FOREIGN PATENT DOCUMENTS

JP 2010-032758 A 2/2010
JP 2011-209490 A 10/2011

* cited by examiner

*Primary Examiner* — Sandra Brase
(74) *Attorney, Agent, or Firm* — Studebaker & Brackett PC

(57) ABSTRACT

A photosensitive member refreshing device includes an image bearing member, an exposure device, a developing device, a detecting section, a cleaning section, and a control section. The image bearing member has a photosensitive roller rotatable about a rotation axis. The exposure device exposes the photosensitive roller to light according to an exposure pattern. The developing device supplies a toner to the photosensitive roller to form a toner image corresponding to the exposure pattern on the photosensitive roller after the exposure device has exposed the photosensitive roller to light. The detecting section detects the toner image on the image bearing member. The cleaning section cleans a surface of the photosensitive roller. The control section controls the exposure pattern based on a result of detection by the detecting section.

11 Claims, 8 Drawing Sheets

PHOTOSENSITIVE MEMBER REFRESHING DEVICE AND IMAGE FORMING APPARATUS

INCORPORATION BY REFERENCE

The present application claims priority under 35 U.S.C. §119 to Japanese Patent Application No. 2014-030694, filed Feb. 20, 2014. The contents of this application are incorporated herein by reference in their entirety.

BACKGROUND

The present disclosure relates to a photosensitive member refreshing device and an image forming apparatus.

A photosensitive drum (photosensitive roller) in an electrophotographic image forming apparatus has a photosensitive layer on a surface thereof. Photosensitive layers are categorized as organic photosensitive members, selenium arsenic photosensitive members, amorphous silicon photosensitive members, or the like according to their principal components. The organic photosensitive members are relatively inexpensive but need to be replaced frequently as being susceptible to wear. The selenium arsenic photosensitive members have a longer life as compared with the organic photosensitive members but are difficult to handle as including a toxic substance. The amorphous silicon photosensitive members are harder, more resistant to wear deterioration, and easier to handle as being harmless substances. Therefore, amorphous silicon photosensitive drums are insusceptible to deterioration of properties of their photosensitive layers and allow maintenance of high image quality even after prolonged usage. Thus, the amorphous silicon photosensitive members are advantageous in terms of environmental friendliness and prevention of cost increase, and therefore the demand for amorphous silicon photosensitive drums has been increasing recently.

Meanwhile, photosensitive drums can be a cause of a phenomenon referred to as image deletion. The image deletion is the phenomenon that describes occurrence of a blurred image or an edge stagnant image. The image deletion occurs because discharge products such as a nitric acid ion and an ammonium ion produced through discharge from a conductive member attach to a surface of a photosensitive drum, and the discharge products are ionized in a high humidity environment to partially reduce the surface resistance of the photosensitive drum. An electrostatic latent image formed on a film having a reduced surface resistance runs outward to cause potential drop. As a result, the boundary of the electrostatic latent image becomes unclear, leading to the image deletion.

The image deletion occurs pronouncedly in an image forming apparatus including an amorphous silicon photosensitive member. This is because the amorphous silicon photosensitive member has a surface that is insusceptible to wear with a blade (cleaning blade) or the like, and the surface easily absorbs moisture.

In a known technique, therefore, aging is performed on a photosensitive drum prior to image formation in order to prevent the image deletion. The aging is to grind and remove discharge products deposited on the surface of the photosensitive drum. Some image forming apparatuses vary the duration of the aging according to the degree of the image deletion.

SUMMARY

A photosensitive member refreshing device according to the first aspect of the present disclosure includes an image bearing member, an exposure device, a developing device, a detecting section, a cleaning section, and a control section. The image bearing member has a photosensitive roller rotatable about a rotation axis. The exposure device exposes the photosensitive roller to light according to an exposure pattern. The developing device supplies a toner to the photosensitive roller to form a toner image corresponding to the exposure pattern on the photosensitive roller after the exposure device has exposed the photosensitive roller to light. The detecting section detects the toner image on the image bearing member. The cleaning section cleans a surface of the photosensitive roller. The control section controls the exposure pattern based on a result of detection by the detecting section.

An image forming apparatus according to the second aspect of the present disclosure includes a photosensitive member refreshing device according to the first aspect of the present disclosure and an image forming section. The image forming section forms an image on a sheet.

DETAILED DESCRIPTION

Figure 1:
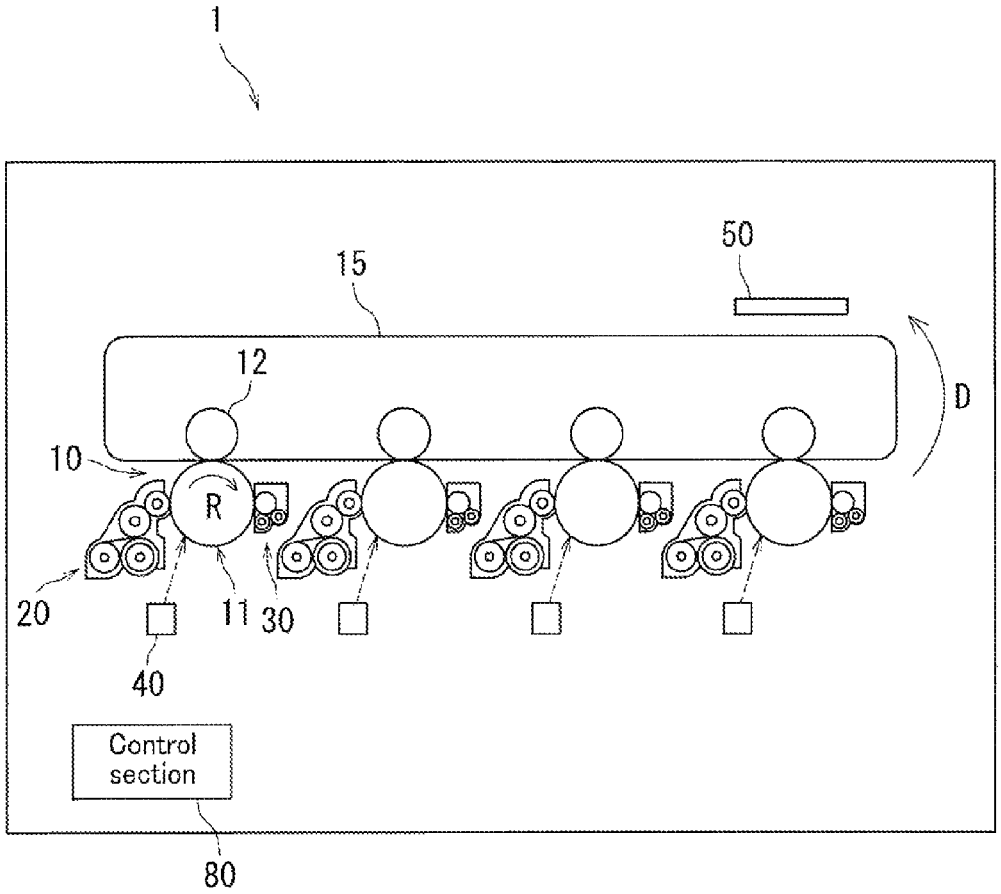
FIG. 1 is a schematic illustration showing a general configuration of a photosensitive member refreshing device according to the first embodiment of the present disclosure.

Hereinafter, embodiments of the present disclosure will be described with reference to the accompanying drawings. It should be noted that the same reference numerals denote the same or equivalent elements in the drawings, and the description thereof will not be repeated.

First Embodiment

Basic Principle

The basic principle of a photosensitive member refreshing device 1 according to the first embodiment of the present disclosure will be described with reference to FIGS. 1-3. FIG. 1 shows a general configuration of the photosensitive member refreshing device 1.

The photosensitive member refreshing device 1 includes an image bearing member 10, an exposure device 40, a developing device 20, a detecting section 50, a cleaning section 30, and a control section 80. The image bearing member 10 has a photosensitive roller 11 rotatable about a rotation axis and an intermediate transfer belt 15. The exposure device 40 exposes the photosensitive roller 11 to light according to an exposure pattern. The detecting section 50 detects a toner image on (transferred onto) the image bearing member 10.

Figure 2:
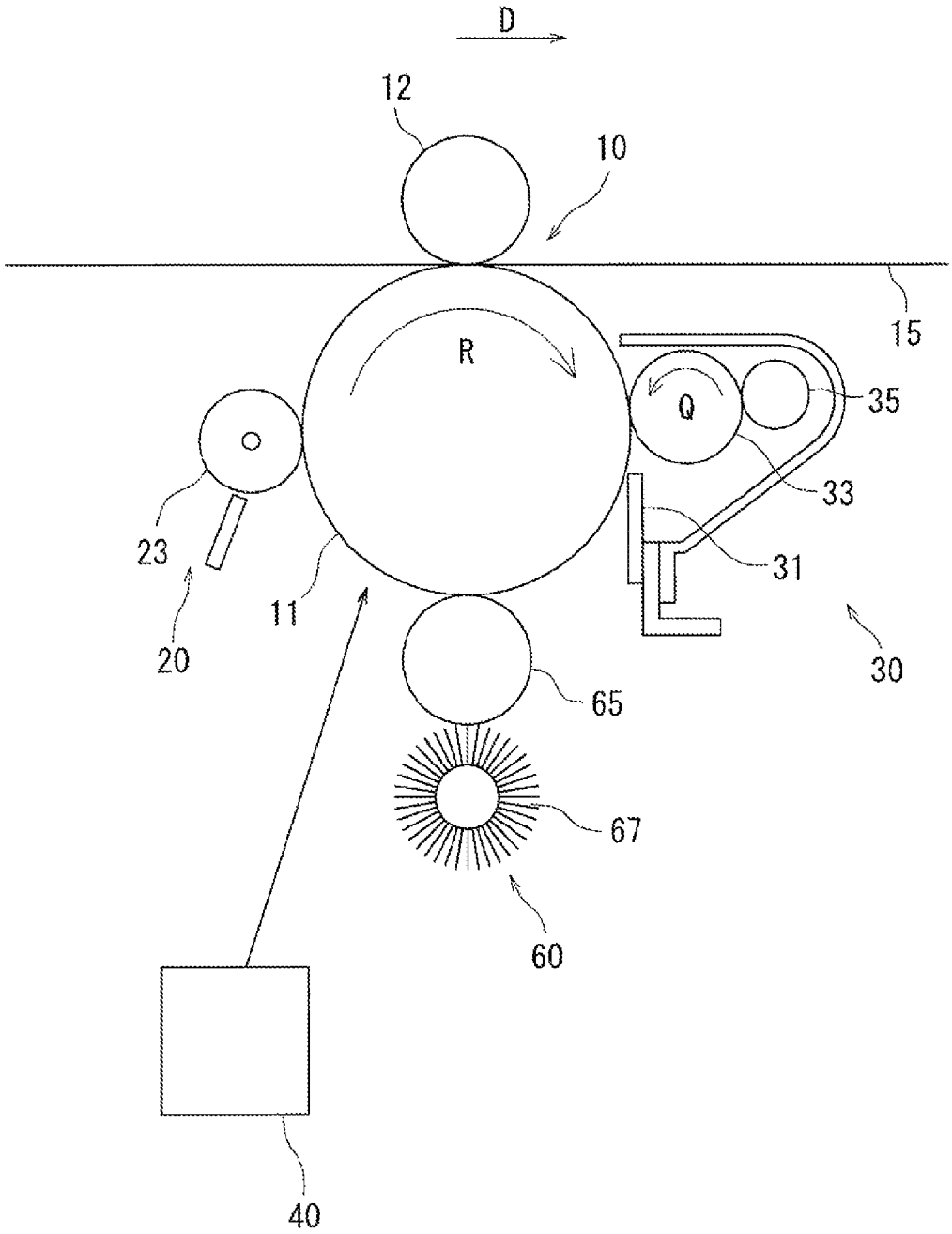
FIG. 2 is an enlarged view of a part of the photosensitive member refreshing device according to the first embodiment of the present disclosure.

FIG. 2 is an enlarged view of the photosensitive member refreshing device 1. The developing device 20 supplies a toner to the photosensitive roller 11 to form a toner image corresponding to the exposure pattern 70 on the photosensitive roller 11 after the exposure device 40 has exposed the photosensitive roller 11 to light. The cleaning section 30 cleans a surface of the photosensitive roller 11. FIG. 3 is a block diagram illustrating the photosensitive member refreshing device 1. The control section 80 controls the exposure pattern of the exposure device 40 based on a result of detection by the detecting section 50.

According to the first embodiment, the exposure pattern of the exposure device 40 is controlled based on the result of the detection by the detecting section 50, and a toner image corresponding to the exposure pattern based on the result of the detection is formed on the photosensitive roller 11. For example, the exposure device 40 performs exposure in the exposure pattern so that more toner is supplied to a region where the image deletion has occurred. As a result, the cleaning section 30 can clean the photosensitive roller 11 using an appropriate amount of toner. That is, the developing device 20 can supply the toner selectively to the region where the image deletion has occurred.

In the present specification, a direction along the rotation axis of the photosensitive roller 11 is defined as a main scanning direction, and a direction perpendicular to the main scanning direction is defined as a sub-scanning direction. A dimension along the main scanning direction is defined as a width, and a dimension along the sub-scanning direction is defined as a length.

(Photosensitive Member Refreshing Device 1)

The photosensitive member refreshing device 1 will be described with reference to FIG. 1. The photosensitive member refreshing device 1 further includes a primary transfer roller 12. In the present embodiment, four assemblages having the same configuration are disposed along the intermediate transfer belt 15. Each of the four assemblages has the photosensitive roller 11, the developing device 20, the cleaning section 30, the exposure device 40, and the primary transfer roller 12. Accordingly, redundant explanation is omitted in order to avoid repetition. The four developing devices 20 supply different colors of toners to the respective photosensitive rollers 11.

The intermediate transfer belt 15 is an endless belt and rotates in a rotation direction D. The photosensitive rollers 11 are disposed on the outer circumferential surface of the intermediate transfer belt 15 and rotate in a rotation direction R. The primary transfer rollers 12 are disposed facing the respective photosensitive rollers 11 via the intermediate transfer belt 15. The developing devices 20, the cleaning sections 30, and the exposure devices 40 are disposed around the respective photosensitive rollers 11.

Each of the exposure devices 40 irradiates the corresponding photosensitive roller 11 with light to form an electrostatic latent image corresponding to the exposure pattern on the surface of the photosensitive roller 11. The developing devices 20 supply the toners onto the respective photosensitive rollers 11. Each of the toners supplied from the developing devices 20 onto the photosensitive rollers 11 attaches to the electrostatic latent image formed on the corresponding photosensitive roller 11. As a result, a toner image corresponding to the electrostatic latent image is formed on the surface of each photosensitive roller 11.

Each of the photosensitive rollers 11 has a cylindrical substrate and a photosensitive layer having a thickness of 10 μm to several tens of μm formed on a surface of the substrate. The primary transfer rollers 12 transfer the toner images formed on the surfaces of the respective photosensitive rollers 11 onto the intermediate transfer belt 15. The toner images are superimposedly transferred from the respective photosensitive rollers 11 to the outer circumferential surface of the intermediate transfer belt 15.

The cleaning sections 30 continue to rotate in a specified direction after the transfer of the toner images from the photosensitive rollers 11 to the intermediate transfer belt 15 thereby to rub the surfaces of the respective photosensitive rollers 11. The cleaning sections 30 clean the surfaces of the respective photosensitive rollers 11 by rubbing the surfaces of the photosensitive rollers 11 and removing toners remaining thereon. The cleaning sections 30 also clean discharge products deposited on the surfaces of the respective photosensitive rollers 11 by rubbing the surfaces with the remaining toners.

In the present embodiment, the detecting section 50 detects the toner images transferred onto the intermediate transfer belt 15. The control section 80 controls each of the exposure devices 40 to perform exposure in a cleaning pattern based on the result of the detection by the detecting section 50.

The cleaning of the toner images developed on the photosensitive rollers 11 by the cleaning sections 30 is referred to as refreshing. Specifically, the cleaning pattern exposure by the exposure devices 40 and the subsequent cleaning of the toner images formed on the surfaces of the photosensitive rollers 11 by the cleaning sections 30 are referred to as refreshing. The refreshing is performed before or after image formation.

Next, the photosensitive member refreshing device 1 will be described in detail with reference to FIG. 2. Each of the developing devices 20 includes a developing roller 23. Each of the developing rollers 23 supplies a toner to the electrostatic latent image formed on the surface of the corresponding photosensitive roller 11. The toners are supplied to the developing devices 20 from a toner replenishing section.

Each of the cleaning sections 30 includes a cleaning blade 31, a friction roller 33, and a toner collecting roller 35. Each of the cleaning blades 31 is fixed in contact with the corresponding photosensitive roller 11. Each of the friction rollers 33 is disposed so as to be in pressed contact with the corresponding photosensitive roller 11. Each of the toner collecting rollers 35 is disposed adjacent to the corresponding friction roller 33.

The cleaning blades 31 remove toners remaining on the surfaces of the respective photosensitive rollers 11. The friction rollers 33 are driven to rotate in a rotation direction Q while being pressed against the respective photosensitive rollers 11 at a predetermined pressure. While rotating, the friction rollers 33 remove the toners remaining on the surfaces of the respective photosensitive rollers 11 at interfaces between the friction rollers 33 and the photosensitive rollers 11, and rub the surfaces of the photosensitive rollers 11 for cleaning. The toner collecting rollers 35 rotate in a direction opposite to the rotation direction Q of the friction rollers 33 while being in contact with the surfaces of the respective friction rollers 33 thereby to collect the toners on the friction rollers 33. The toners collected are dropped into a residual toner conveyance path disposed below the cleaning sections 30 and recovered.

Each of the assemblages has a charger 60 including a charging roller 65 and a cleaning brush 67. The chargers 60 uniformly charge the surfaces of the respective photosensitive rollers 11. Each of the charging rollers 65 is disposed in contact with the corresponding photosensitive roller 11 and driven to rotate by the rotation of the photosensitive roller 11. Each of the charging rollers 65 applies a voltage to the surface of the corresponding photosensitive roller 11 so that the surface of the photosensitive roller 11 is uniformly charged. Each of the cleaning brushes 67 is disposed under the corresponding charging roller 65 and driven to rotate by the charging roller 65. The cleaning brushes 67 remove unwanted matters such as toners on the surfaces of the respective charging rollers 65.

Figure 4:
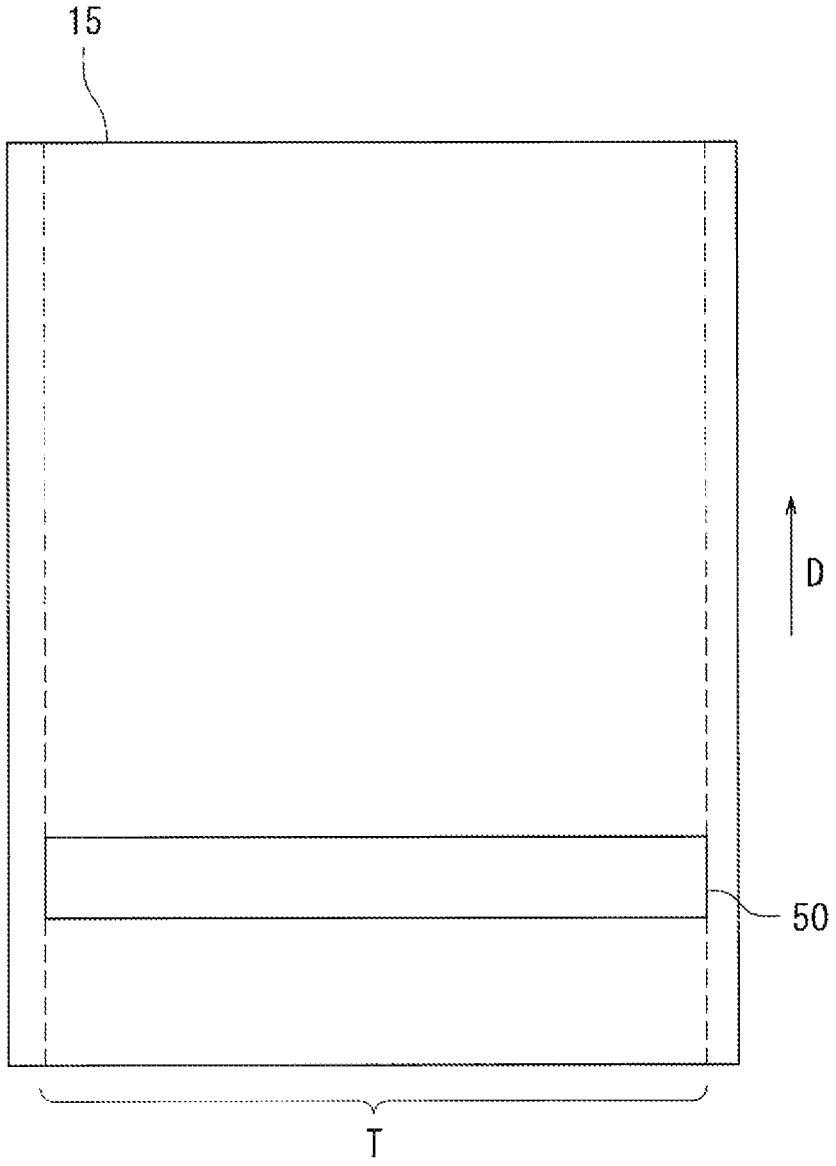
FIG. 4 is a top view of a detecting section of the photosensitive member refreshing device according to the first embodiment of the present disclosure.

The detecting section 50 will be described with reference to FIG. 4. FIG. 4 is a top view of the detecting section 50 of the photosensitive member refreshing device 1. A region T of the intermediate transfer belt 15 in which the toner images can be formed is indicated by dashed lines in FIG. 4. The detecting section 50 is a sensor having a linear shape extending from a location facing one end of the intermediate transfer belt 15 in the width direction of the intermediate transfer belt 15 to a location facing the other end. The detecting section 50 can therefore detect the toner images from one end to the other end of the region T in the width direction of the intermediate transfer belt 15. The width direction of the intermediate transfer belt 15 is parallel to the main scanning direction of each photosensitive roller 11. As a result, the detecting section 50 can detect a site of image deletion in each photosensitive roller 11 in terms of the main scanning direction of the photosensitive roller 11. The detecting section 50 sends the result of the detection to the control section 80 (see FIG. 1). Although the region T is indicated by the dashed lines in FIG. 4 for the purpose of illustration, the actual intermediate transfer belt 15 is not sectioned but constitutes a continuous region.

The sensor is for example a contact image sensor. The contact image sensor has an image sensor and an array of lenses with the same magnification. Since the contact image sensor has the array of lenses with the same magnification, the distance from an object being detected to the image sensor is short. Accordingly, a space for disposing the detecting section 50 can be small. The contact image sensor may further have a light source as needed.

Figure 5:
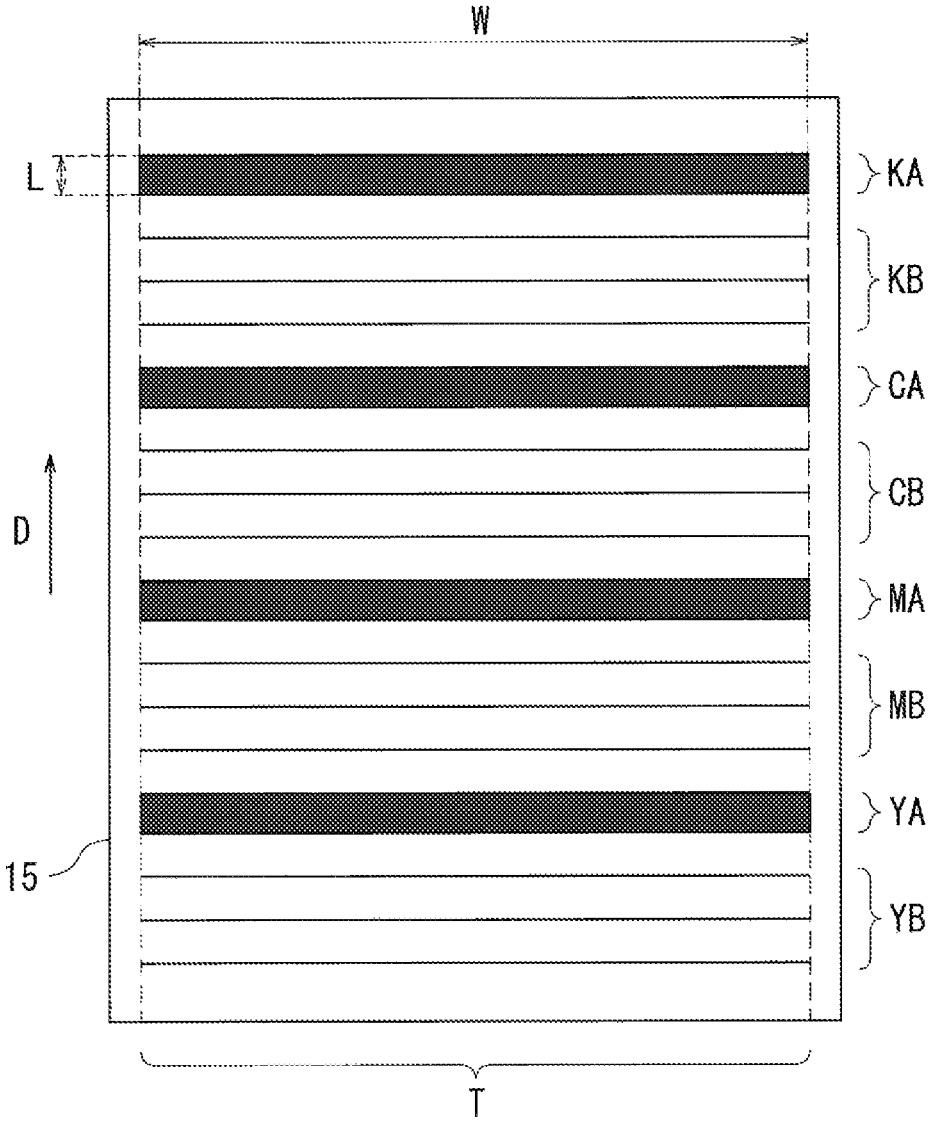
FIG. 5 is a diagram showing toner images transferred onto an image bearing member (intermediate transfer belt) according to the first embodiment of the present disclosure.

The toner images will be described with reference to FIGS. 2, 5, and 6A-6B. FIG. 5 illustrates an example of the toner images transferred onto the intermediate transfer belt 15. The toner images are formed based on the exposure patterns controlled by the control section 80. Each of the exposure patterns extends from one end to the other end of the region T in the main scanning direction of each photosensitive roller 11. The toner images are formed on the respective photosensitive rollers 11 for four colors. For example, a toner image formed using a black toner includes one thick line KA and three thin lines KB as shown in FIG. 5. A width W of the thick line KA is a dimension along the main scanning direction of the corresponding photosensitive roller 11, and a length L of the thick line KA is a dimension along the sub-scanning direction of the photosensitive roller 11. Likewise, the toner image formed using a cyan toner includes one thick line CA and three thin lines CB, the toner image formed using a magenta toner includes one thick line MA and three thin lines MB, and the toner image formed using a yellow toner includes one thick line YA and three thin lines YB.

It is noted here that a shorter exposure pattern length on the photosensitive rollers 11 is more likely to cause image deletion, while a longer exposure pattern length is less likely to cause image deletion. Accordingly, each toner image is formed from an image having a longer length and an image having a shorter length. As a result, the detecting section 50 can detect and compare densities of the images, and thus detect whether or not image deletion has occurred.

The length L of the thick line KA is longer than the length of each of the thin lines KB. Accordingly, the detecting section 50 can detect whether or not image deletion in black has occurred by comparing the density of the thick line KA and the density of the thin lines KB. Whether or not image deletion in cyan, magenta, and yellow has occurred can be detected in the same manner.

Figure 6A:
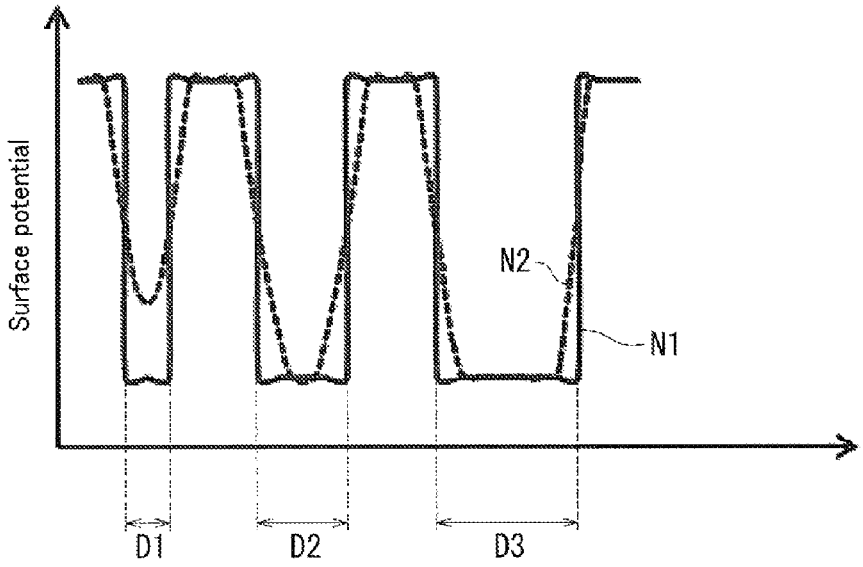
FIG. 6A is a diagram showing the surface potential relative to exposure patterns in the photosensitive member refreshing device according to the first embodiment of the present disclosure.
Figure 6B:
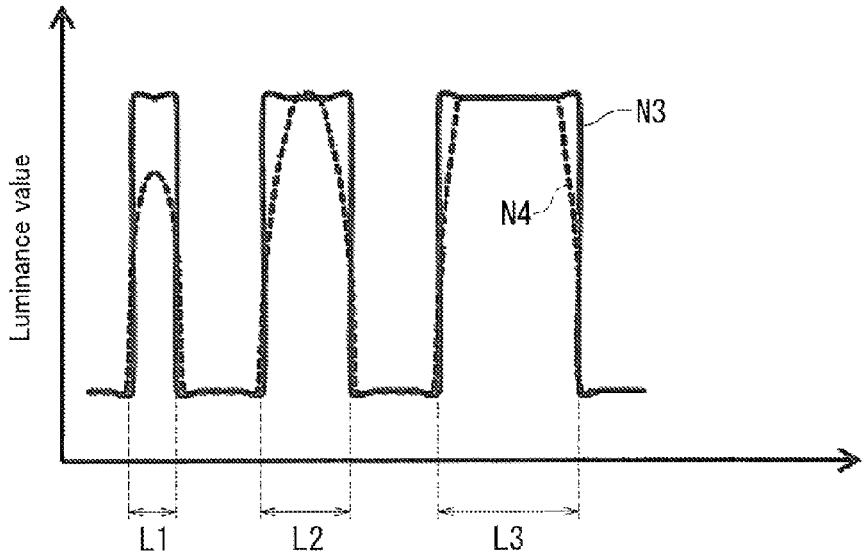
FIG. 6B is a diagram showing the toner image luminance value relative to exposure patterns.

The relationship between the toner image length and the luminance value will be described with reference to FIGS. 6A and 6B. FIG. 6A shows the surface potential relative to exposure patterns. FIG. 6B shows the toner image luminance value relative to exposure patterns.

First, the relationship between exposure patterns and the surface potential in the case of normal toner image formation (no image deletion) and in the case of image deletion will be explained with reference to FIG. 6A. The vertical axis represents the surface potential of given one of the photosensitive rollers 11. The horizontal axis represents the exposure patterns. A line N1 represents the surface potential relative to the exposure patterns in the case of normal toner image formation. A line N2 represents the surface potential relative to the exposure patterns in the case of image deletion. A length D1 is 2 dots, a length D2 is 4 dots, and a length D3 is 6 dots, for example.

The difference between the surface potential in the case of image deletion and the surface potential in the case of normal toner image formation is greater when the exposure pattern length is D2 than when the exposure pattern length is D3. The diagram therefore indicates that the surface potential in the case of image deletion is more unclear in the boundary of the exposure pattern when the exposure pattern length is D2 than when the exposure pattern length is D3. In addition, the difference between the surface potential in the case of image deletion and the surface potential in the case of normal toner image formation is greater when the exposure pattern length is D1 than when the exposure pattern length is D2. The diagram therefore indicates that the surface potential in the case of image deletion is more unclear in the boundary of the exposure pattern when the exposure pattern length is D1 than when the exposure pattern length is D2. That is, the diagram indicates that in the case of image deletion, the shorter the exposure pattern length is, the greater the difference between the boundary of the surface potential and the exposure pattern is, and the more unclear the boundary of the surface potential is.

Next, the relationship between the toner image luminance value and exposure patterns in the case of normal toner image formation and in the case of image deletion will be explained with reference to FIG. 6B. The vertical axis represents the toner image luminance value. The horizontal axis represents the exposure pattern length. A line N3 represents the toner image luminance value in the case of normal toner image formation. A line N4 represents the toner image luminance value in the case of image deletion. A length L1 is 2 dots, a length L2 is 4 dots, and a length L3 is 6 dots, for example.

The difference between the toner image luminance value in the case of image deletion and the luminance value in the case of normal toner image formation is greater when the exposure pattern length is L2 than when the exposure pattern length is L3. The diagram therefore indicates that the luminance value in the case of image deletion is more unclear in the boundary of the exposure pattern when the exposure pattern length is L2 than when the exposure pattern length is L3. In addition, the difference between the luminance value in the case of image deletion and the luminance value in the case of normal toner image formation is greater when the exposure pattern length is L1 than when the exposure pattern length is L2. The diagram therefore indicates that the luminance value in the case of image deletion is more unclear in the boundary of the exposure pattern when the exposure pattern length is L1 than when the exposure pattern length is L2. That is, the diagram indicates that in the case of image deletion, the shorter the toner image length is, the more unclear the boundary of the luminance value is. It is therefore concluded that the shorter the toner image length is, the more blurred the toner image looks.

As explained with reference to FIGS. 6A and 6B, the shorter the exposure pattern length is, the more unclear the boundary of the surface potential of the photosensitive roller 11 is. Accordingly, the boundary of the luminance value is unclear in the toner image corresponding to the exposure pattern in which the boundary of the surface potential is unclear. It is therefore concluded that the shorter the toner image length is, the more unclear the boundary of the toner image luminance value is.

Figure 7:
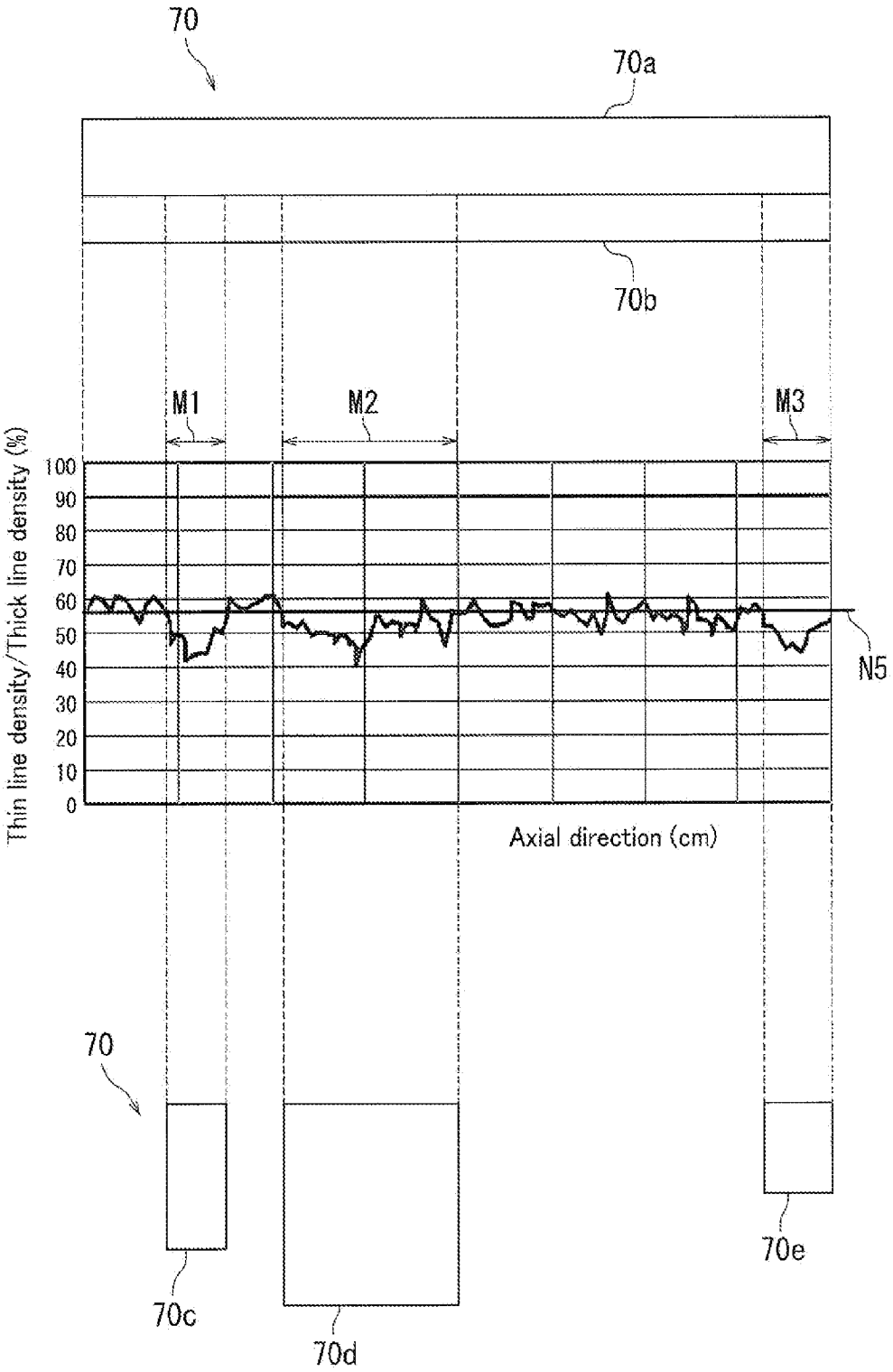
FIG. 7 is a diagram showing exposure patterns of an exposure device, a result of detection by the detecting section, and exposure patterns controlled by a control section in the photosensitive member refreshing device according to the first embodiment of the present disclosure.

An exposure pattern controlled based on the result of the detection by the detecting section 50 will be described with reference to FIG. 7. A top part of FIG. 7 shows the exposure pattern 70 of given one of the exposure devices 40. The exposure pattern 70 includes a thick line pattern 70*a* (first line) and a thin line pattern 70*b* (second line). The thick line pattern 70*a* and the thin line pattern 70*b* extend in the main scanning direction. The length of the thick line pattern 70*a* and the length of the thin line pattern 70*b* are constant in the main scanning direction of the exposure pattern 70. The length of the thick line pattern 70*a* is longer than the length of the thin line pattern 70*b*. The width of the thick line pattern 70*a* and the width of the thin line pattern 70*b* are the same.

As explained with reference to FIGS. 6A and 6B, the shorter the toner image length is, the more unclear the boundary of the toner image luminance value on the photosensitive roller 11 is. That is, the toner image formed according to the thick line pattern 70*a* is less likely to have a reduced luminance value, and the toner image formed according to the thin line pattern 70*b* is more likely to have a reduced luminance value. The detecting section 50 can therefore determine the degree of image deletion by detecting and comparing the luminance value of the toner image formed according to the thick line pattern 70*a* and the luminance value of the toner image formed according to the thin line pattern 70*b*.

A middle part of FIG. 7 shows a result of the detection by the detecting section 50. The vertical axis represents a percentage (%) of a thin line density relative to a thick line density. The thick line density is a density of the toner image formed according to the thick line exposure pattern (thick line pattern 70*a*). The thin line density is a density of the toner image formed according to the thin line exposure pattern (thin line pattern 70*b*). The horizontal axis represents positions in terms of the main scanning direction of the photosensitive roller 11 and corresponds to the main scanning direction of the exposure pattern shown in the top part of FIG. 7. A line N5 represents a threshold value for the determination of occurrence of image deletion in the toner image by the detecting section 50. The detecting section 50 determines that image deletion has occurred when the percentage of the thin line density relative to the thick line density is smaller than the threshold value. The detecting section 50 determines that image deletion has not occurred when the percentage of the thin line density relative to the thick line density is equal to or larger than the threshold value. However, it may be determined that image deletion has not occurred even when the percentage of the thin line density relative to the thick line density is smaller than the threshold value so long as the percentage smaller than the threshold value is intermittent without exceeding a predetermined value in the main scanning direction of the intermediate transfer belt 15. The predetermined value may be preliminarily put in a table form as a parameter and stored in the control section 80.

It is indicated that the percentage of the thin line density relative to the thick line density is smaller than the threshold value in a site M1, a site M2, and a site M3 in the toner image detected. Accordingly, the detecting section 50 determines that image deletion has occurred in the sites M1, M2, and M3, and sends the result of the detection to the control section 80.

A bottom part of FIG. 7 shows the exposure pattern 70 controlled by the control section 80 based on the result of the detection by the detecting section 50 shown in the middle part of FIG. 7. When the detecting section 50 determines that image deletion has occurred, the control section 80 determines the exposure pattern 70 according to the degree of the image deletion. An exposure pattern 70*c* is corresponding to the result of the detection in the site M1. An exposure pattern 70*d* is corresponding to the result of the detection in the site M2. An exposure pattern 70*e* is corresponding to the result of the detection in the site M3. The widths of the exposure patterns 70*c*, 70*d*, and 70*e* are substantially the same as the widths of respective regions where the percentage of the thin line density relative to the thick line density is smaller than the threshold value for determining occurrence of image deletion. Accordingly, the width of the site M1 is substantially the same as the width of the exposure pattern 70*c*, the width of the site M2 is substantially the same as the width of the exposure pattern 70*d*, and the width of the site M3 is substantially the same as the width of the exposure pattern 70*e*.

The control section 80 adjusts the length of each pattern of the exposure by the exposure device 40 based on the degree of the image deletion. Preferably, the amount of toner to supply to each photosensitive roller 11 is increased for a higher degree of image deletion. Accordingly, the length of the pattern of the exposure by the exposure device 40 is increased so that the amount of toner to be supplied is increased in the case of a higher degree of image deletion. On the contrary, the length of the pattern of the exposure by the exposure device 40 is decreased so that the amount of toner to be supplied is decreased in the case of a lower degree of image deletion. As a result, an appropriate amount of toner is supplied according to the degree of the image deletion.

The percentage of the thin line density relative to the thick line density in the site M1 shown in the middle part of FIG. 7 (the percentage in the site M1) is larger than the percentage of the thin line density relative to the thick line density in the site M2 (the percentage in the site M2) and smaller than the percentage of the thin line density relative to the thick line density in the site M3 (the percentage in the site M3). Accordingly, the length of the exposure pattern 70*c* is shorter than the length of the exposure pattern 70*d* and longer than the length of the exposure pattern 70*e*. The percentage in the site M2 is smaller than the percentage in the site M1 and the percentage in the site M3. Accordingly, the length of the exposure pattern 70*d* is longer than the length of the exposure pattern 70*c* and the length of the exposure pattern 70*e*. The percentage in the site M3 is larger than the percentage in the site M1 and the percentage in the site M2. Accordingly, the length of the exposure pattern 70*e* is shorter than the length of the exposure pattern 70*c* and the length of the exposure pattern 70*d*.

The control section 80 adjusts the duration of the cleaning of the photosensitive rollers 11 by the cleaning sections 30 according to the degree of the image deletion detected by the detecting section 50. Specifically, the duration of the cleaning is made shorter when the percentage of the thin line density relative to the thick line density is larger, and the duration of the cleaning is made longer when the percentage of the thin line density relative to the thick line density is smaller. That is, the control section 80 makes the duration of the cleaning by the cleaning section 30 shorter for a larger percentage of the density of a toner image corresponding to the thin line 70*b* relative to the density of a toner image corresponding to the thick line 70*a*. As a result, the refreshing can be performed for an appropriate duration according to the degree of the image deletion.

According to the present embodiment, as described with reference to FIGS. 1-7, the exposure pattern 70 is controlled based on the result of the detection by the detecting section 50. Thus, an electrostatic latent image according to the exposure pattern 70 controlled based on the result of the detection is formed on each photosensitive roller 11. As a result, each cleaning section 30 can clean the corresponding photosensitive roller 11 with an appropriate amount of toner.

In the present embodiment, the detecting section 50 detects image deletion based on the percentage of the thin line density relative to the thick line density. It is noted that the detecting section 50 is a sensor having a linear shape extending in the width direction of the intermediate transfer belt 15 (main scanning direction). The exposure pattern for detecting image deletion also extends in the width direction of the intermediate transfer belt 15. The detecting section 50 can therefore detect a region having a higher toner density and a region having a lower toner density of one toner image in terms of the width direction. The detecting section 50 can therefore detect image deletion only with a thick line or only with a thin line.

Second Embodiment

Figure 8:
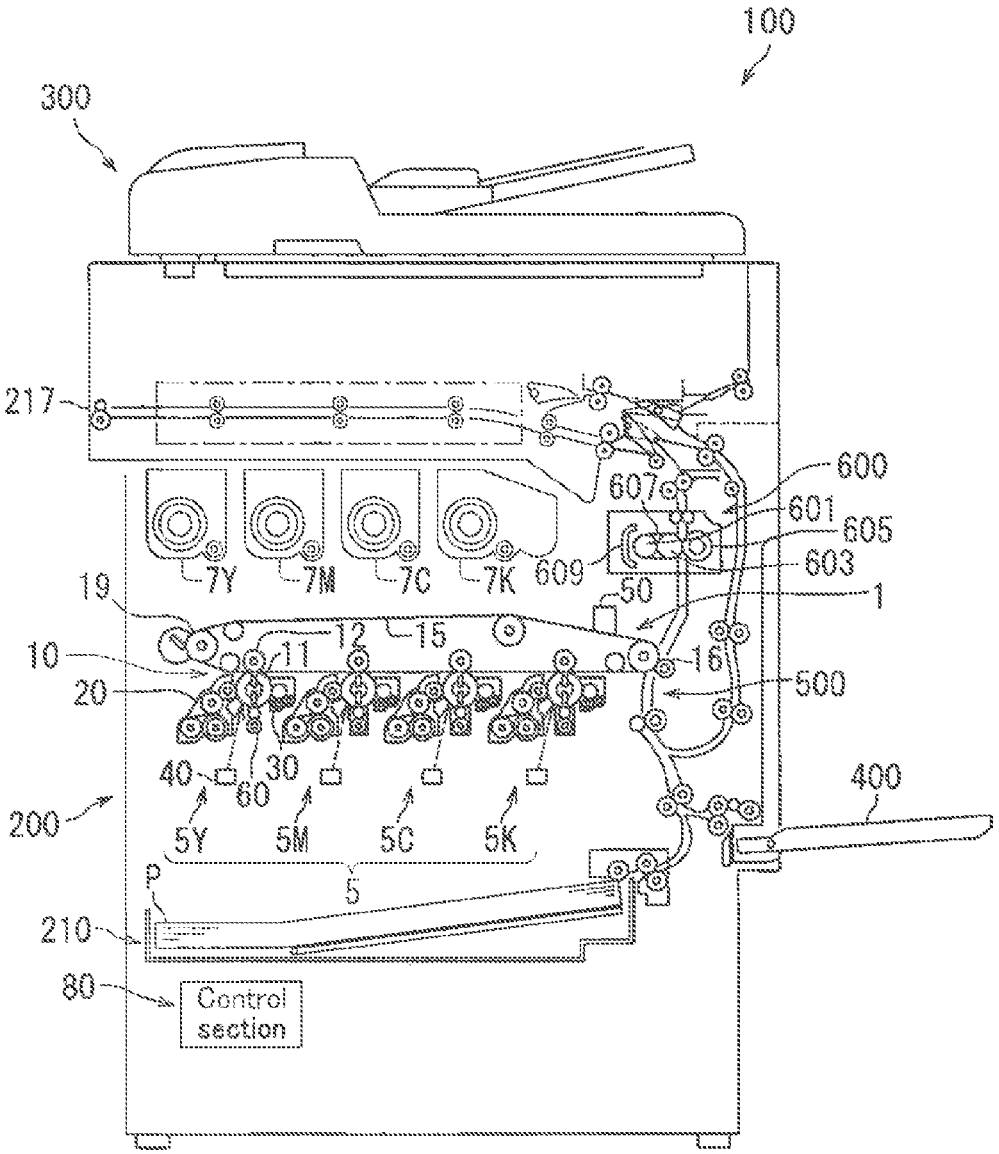
FIG. 8 is a schematic cross sectional view illustrating an overview of an image forming apparatus according to the second embodiment of the present disclosure.

An image forming apparatus 100 according to the second embodiment of the present disclosure will be described with reference to FIG. 8. FIG. 8 is a schematic cross sectional view illustrating an overview of the image forming apparatus 100.

The image forming apparatus 100 includes a main body 200 and an image reading section 300. The image reading section 300 is disposed on the top surface of the main body 200. The image reading section 300 optically reads an original document to be copied and generates image data.

The main body 200 accommodates the photosensitive member refreshing device 1, a sheet feed cassette 210, a conveyance section 500, and a fixing section 600. The photosensitive member refreshing device 1 functions as an image forming section. The sheet feed cassette 210 is disposed in a lower part of the main body 200 and stores therein a sheet P to be conveyed to the image forming section. The conveyance section 500 is a path which extends from the sheet feed cassette 210 or a manual sheet feed tray 400 to an ejection roller pair 217 via the image forming section and the fixing section 600, and through which the sheet P is conveyed. The fixing section 600 fixes a toner image on the sheet P.

The image forming section transfers toner images of four colors to the intermediate transfer belt 15. The image forming section includes an image forming unit 5 and a toner replenishing section 7. The image forming unit 5 includes an image forming unit 5Y that forms a yellow toner image, an image forming unit 5M that forms a magenta toner image, an image forming unit 5C that forms a cyan toner image, and an image forming unit 5K that forms a black toner image.

The image forming unit 5Y includes the photosensitive roller 11, the primary transfer roller 12, the developing device 20, the cleaning section 30, the exposure device 40, and the charger 60. The image forming units 5M, 5C, and 5K have the same configuration as the image forming unit 5Y. The intermediate transfer belt 15 of the image bearing member 10 is wound around a drive roller 16 and a driven roller 19.

The toner replenishing section 7 includes a toner container 7Y that stores therein a yellow toner, a toner container 7M that stores therein a magenta toner, a toner container 7C that stores therein a cyan toner, and a toner container 7K that stores therein a black toner. The toners of the respective colors stored in the toner containers 7Y, 7M, 7C, and 7K are supplied to the developing devices 20 for the respective colors in the image forming units 5Y, 5M, 5C, and 5K.

The sheet feed cassette 210 accommodates the sheet P. The sheet P is plain paper, recycled paper, thin paper, thick paper, an overhead projector (OHP) sheet, for example. The manual sheet feed tray 400 is disposed on the outside of the right side of the main body 200. The sheet P is loaded on the manual sheet feed tray 400. The sheet P is conveyed from the sheet feed cassette 210 or the manual sheet feed tray 400 to the conveyance section 500.

The fixing section 600 includes a heating roller 601, a fixing roller 603, a pressure roller 605, a fixing belt 607, and an induction heating unit 609. The pressure roller 605 is in pressed contact with the fixing roller 603 to form a fixing nip part. The heating roller 601 and the fixing belt 607 are induction-heated by the induction heating unit 609. The heat of the heating roller 601 and the heat of the fixing belt 607 is applied to the fixing nip part. The sheet P bearing the toner images is conveyed to the fixing section 600. The sheet P passes through the fixing nip part, and thus the toner images are fixed onto the sheet P. The ejection roller pair 217 ejects the sheet P onto an exit tray.

The control section 80 initiates the refreshing before the sheet P is conveyed from the sheet feed cassette 210 or the manual sheet feed tray 400 to the conveyance section 500. In response to the initiation of the refreshing, the detecting section 50 detects the toner images formed on the intermediate transfer belt 15.

So far, the embodiments of the present disclosure have been described with reference to the drawings (FIGS. 1-8). However, the present disclosure is not limited to the above-described embodiments and can be practiced in various ways within the scope not departing from the gist of the present disclosure (e.g., (1) to (8) described below). The drawings are intended to illustrate mainly the components in a schematic manner to assist with understanding. The thickness, the length, the number, and so on of each component illustrated are not true to scale for diagrammatic purposes. The shape, the dimension, and so on of each component shown in the above-described embodiments are exemplary only and not particularly limited. Various alternations can be made thereto within the scope not substantially departing from the effect of the present disclosure.

(1) One detecting section 50 is disposed above the intermediate transfer belt 15 according to the description made with reference to FIG. 4. Alternatively, a plurality of detecting sections 50 may be provided. The detecting section 50 has a linear shape extending from one end to the other end in the width direction of the intermediate transfer belt 15 according to the description made above. Alternatively, the detecting section 50 does not need to extend from one end to the other end so long as it has a linear shape.

(2) The photosensitive member refreshing device 1 includes four photosensitive rollers 11 according to the description made with reference to FIG. 1. Alternatively, the photosensitive member refreshing device 1 may include one photosensitive roller 11, or two, three, or five or more photosensitive rollers 11.

(3) The detecting section 50 is disposed above and opposed to the intermediate transfer belt 15 according to the description made with reference to FIGS. 1, 4, and 8. Alternatively, the detecting section 50 may be disposed adjacent to each of one or more photosensitive rollers 11. In this case, each detecting section 50 detects image deletion of a toner image formed on the corresponding photosensitive roller 11.

(4) The toner images on the image bearing member 10 are formed using the toners of the four colors, and the toner images of the four colors are each formed from one thick line and three thin lines according to the description made with reference to FIG. 5. Alternatively, the toner images of the four colors may be each formed from a plurality of thick lines and one, two, or four or more thin lines.

(5) The three thin lines forming each toner image on the image bearing member 10 have the same length according to the description made with reference to FIG. 5. Alternatively, the three thin lines may have different lengths.

(6) The toner images on the image bearing member 10 are formed using the toners of the four colors, and the toner images are formed based on the same pattern according to the description made with reference to FIG. 5. Alternatively, the toner images of the four colors may be formed based on different patterns.

(7) The developing devices 20 use the same color for a thick line pattern and thin line patterns to form a toner image, and the toner density for the thick line pattern and the toner density for the thin line patterns are detected by the detecting section 50 according to the description made with reference to FIG. 5. Alternatively, the developing devices 20 may use different colors for a thick line pattern and thin line patterns to form a toner image, and the toner density for the thick line pattern and the toner density for the thin line patterns may be detected by the detecting section 50. That is, the thick line pattern and the thin line pattern are supplied with toners of different colors. Accordingly, toner images of the different colors are formed on the photosensitive rollers 11. The detecting section 50 applies light to each toner image when reading the toner density. For example, red light is not reflected by the cyan toner but green or blue light is reflected by the cyan toner. Accordingly, the density of the cyan toner can be detected by applying green or blue light thereto. In general, the color of the intermediate transfer belt 15 is often black, which is not light-reflecting. Therefore, the accuracy of the detection of the density of the black toner, which does not reflect any color of light, is increased by forming the thick line pattern with the yellow toner, for example, and the thin line patterns with the black toner to perform the detection.

Figure 3:
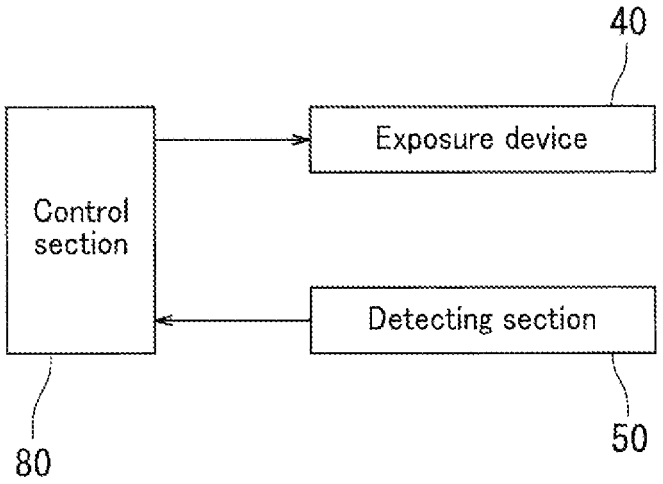
FIG. 3 is a block diagram illustrating the photosensitive member refreshing device according to the first embodiment of the present disclosure.

(8) The photosensitive member refreshing device 1 supplies an appropriate amount of toner to each photosensitive roller 11 based on the result of the detection by the detecting section 50 to perform the refreshing according to the description made with reference to FIGS. 1-3. Alternatively, the toner density may be detected by the detecting section 50 again after the refreshing has been done. The control section 80 may determine whether to cause each exposure device 40 to expose the corresponding photosensitive roller 11 to light again for the refreshing based on the result of the detection. The refreshing may be performed only once, or two or more times.

What is claimed is:

1. A photosensitive member refreshing device comprising:

an image bearing member having a photosensitive roller rotatable about a rotation axis;

an exposure device configured to expose the photosensitive roller to light according to an exposure pattern;

a developing device configured to supply a toner to the photosensitive roller to form a toner image corresponding to the exposure pattern on the photosensitive roller after the exposure device has exposed the photosensitive roller to light;

a detecting section configured to detect the toner image on the image bearing member;

a cleaning section configured to clean a surface of the photosensitive roller; and a control section configured to control the exposure pattern based on a result of detection by the detecting section.

2. A photosensitive member refreshing device according to claim 1, wherein the detecting section detects the toner image formed on the photosensitive roller.

3. A photosensitive member refreshing device according to claim 1, wherein the image bearing member further has an intermediate transfer belt onto which the toner image is transferred from the photosensitive roller, and the detecting section detects the toner image on the intermediate transfer belt.

4. A photosensitive member refreshing device according to claim 1, wherein the exposure pattern extends from one end to the other end of the photosensitive roller in a main scanning direction of the photosensitive roller.

5. A photosensitive member refreshing device according to claim 1, wherein the control section adjusts a length of exposure by the exposure device in a sub-scanning direction of the photosensitive roller based on the result of the detection.

6. A photosensitive member refreshing device according to claim 1, wherein the control section determines whether to cause the exposure device to expose the photosensitive roller to light again based on the result of the detection.

7. A photosensitive member refreshing device according to claim 1, wherein the exposure pattern includes a first line and a second line extending in the main scanning direction, and the first line has a length longer than a length of the second line, the length of the first line and the length of the second line being in parallel with the sub-scanning direction of the photosensitive roller.

8. A photosensitive member refreshing device according to claim 7, wherein the first line and the second line are supplied with toners of different colors to form toner images of the different colors.

9. A photosensitive member refreshing device according to claim 7, wherein the control section makes a duration of cleaning by the cleaning section shorter for a larger percentage of a density of a toner image corresponding to the second line relative to a density of a toner image corresponding to the first line.

10. A photosensitive member refreshing device according to claim 1, wherein the exposure pattern includes a line extending in a main scanning direction of the photosensitive roller, and the detecting section detects, within a toner image corresponding to the line, a region having a lower toner density in terms of the main scanning direction of the photosensitive roller.

11. An image forming apparatus comprising:

a photosensitive member refreshing device according to claim 1; and an image forming section configured to form an image on a sheet.

* * * * *